US012433469B2

(12) United States Patent
Hagee et al.

(10) Patent No.: US 12,433,469 B2
(45) Date of Patent: Oct. 7, 2025

(54) CLEANING APPARATUS

(71) Applicant: The Procter & Gamble Company, Cincinnati, OH (US)

(72) Inventors: Richard Christopher Hagee, Cincinnati, OH (US); Nicola John Policicchio, Mason, OH (US); Victoria Jung, Cincinnati, OH (US); William Michael Cannon, West Harrison, IN (US); John Charles Van Rens, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 4 days.

(21) Appl. No.: 17/969,882

(22) Filed: Oct. 20, 2022

(65) Prior Publication Data

US 2023/0127761 A1 Apr. 27, 2023

Related U.S. Application Data

(60) Provisional application No. 63/270,610, filed on Oct. 22, 2021.

(51) Int. Cl.
*A47L 13/22* (2006.01)

(52) U.S. Cl.
CPC ..... *A47L 13/22* (2013.01)

(58) Field of Classification Search
CPC ..... A47L 13/22; A47L 13/24; A47L 13/25; A47L 13/254; A47L 13/26; A47L 13/30;
(Continued)

(56) References Cited

U.S. PATENT DOCUMENTS 7,055,204 B2 * 6/2006 Ajluni ..... A47L 1/06 15/228
7,708,484 B2 * 5/2010 Tanaka ..... A47L 13/22 401/136

(Continued)

FOREIGN PATENT DOCUMENTS

WO 9823200 A1 6/1998
WO 0122861 A2 4/2001

(Continued)

OTHER PUBLICATIONS

Casabella Radius Spray Mop, Graphite and Orange; Amazon.com (https://www.amazon.com/Casabella-Radius-Spray-Graphite-Orange/dp/B07BHYH243/ref=cm_cr_arp_d_product_top?ie=UTF8&th=1) (Year: 2018).*

(Continued)

*Primary Examiner* — Brian D Keller
*Assistant Examiner* — Sidney D Full
(74) *Attorney, Agent, or Firm* — Gary J. Foose

(57) ABSTRACT

A cleaning apparatus is described. The cleaning apparatus includes a support member and a cleaning head. The support member includes a first portion having a length, a first end, an opposing second end and a handle disposed at the first end; a second portion having a first transition at the second end of the first portion and a second transition spaced from the first transition; a first support and a second support joining the first and the second transitions; and a liquid management system disposed, at least in part, between the first and second transitions. The liquid management system comprises a reservoir receiver. The cleaning head is moveably attached to the second transition. The support member exhibits a longitudinal angle of six degrees or less with respect to a horizontal plane. The cleaning apparatus exhibits a vertical height of less than 110 mm.

18 Claims, 8 Drawing Sheets

(58) Field of Classification Search
CPC ... A46B 11/06; A46B 11/063; A46B 11/0013; A46B 11/0041; A46B 11/0017
USPC ..... 401/137–139, 268; 15/115, 104.92
See application file for complete search history.

(56) References Cited

U.S. PATENT DOCUMENTS 8,425,137 B1 * 4/2013 Sampaio ..... A47L 13/22 401/139
9,320,405 B2 * 4/2016 Luedke ..... A47L 13/225
9,661,975 B2 * 5/2017 Charlton ..... A47L 13/22
2004/0134016 A1 * 7/2004 Kisela ..... A47L 9/2842 15/403
2005/0011536 A1 * 1/2005 Hofte ..... B25G 3/38 15/228
2005/0207825 A1 * 9/2005 Martin ..... A46B 11/0006 401/289
2006/0051642 A1 3/2006 Finnerty
2012/0222227 A1 * 9/2012 Johnson ..... A47L 13/225 15/105

FOREIGN PATENT DOCUMENTS

WO 0241747 A1 5/2002
WO 2004062457 A2 7/2004
WO WO-2018184953 A1 * 10/2018 ..... A47L 13/22

OTHER PUBLICATIONS

WO-2018184953 WIPO Translation; Floor Nozzle for a Steam Cleaner; Dux, Tobias; Oct. 11, 2018 (Year: 2018).*
PCT Search Report and Written Opinion for PCT/US2022/078399 dated Feb. 20, 2023, 12 pages.

* cited by examiner

CLEANING APPARATUS

FIELD OF THE INVENTION

The present invention pertains to cleaning apparatuses, specifically cleaning apparatuses that can accommodate low vertical clearance areas.

BACKGROUND OF THE INVENTION

Cleaning implements for floor cleaning have been utilized for decades to clean hard surfaces. One of the most challenging task that a user has regarding these cleaning implements is cleaning underneath of furniture and appliances. Particularly for floor cleaning, the cleaning implement should be able to accommodate spaces with low vertical clearance.

This accommodation of low vertical clearance can be particularly problematic with cleaning implements which are self-contained. For example, for those cleaning implements to which a bottle may be attached, the problem of accommodating low vertical clearance spaces may be exacerbated. The volume of the bottle can negatively impact the vertical clearance that the cleaning implement may accommodate. And, while a solution may be to reduce the volume of the bottle substantially, such measures are rarely successful.

While the lower volume bottle may allow for the accommodation of lower vertical clearance heights, the lower volume necessarily means a higher frequency of changing of the bottle. Unfortunately, consumers may view such arrangements as low value or wasteful given the more frequent bottle change.

So, what is needed is a cleaning implement that can accommodate low vertical clearances while still providing for sufficient bottle volumes for the user.

SUMMARY OF THE INVENTION

The cleaning apparatuses of the present disclosure can accommodate low vertical clearances of furniture and appliances. In one example, a cleaning apparatus comprises: a cleaning head and a support member comprising: a first portion having a length, a first end and an opposing second end and a handle disposed at the first end of the first portion; a second portion having a first transition disposed at the second end of the first portion and a second transition spaced apart from the first transition; a first support and a second support joining the first transition and the second transition; and a liquid management system disposed, at least in part, between the first transition and second transition, wherein the cleaning head is moveably attached to the second transition. The liquid management system comprises a reservoir receiver which is capable of receiving at least one liquid reservoir or may comprise at least one liquid reservoir formed integrally therewith. The support member exhibits a longitudinal angle of six degrees or less with respect to a horizontal plane, wherein the cleaning apparatus exhibits a vertical height of less than 110 mm, and wherein the liquid reservoir has a volume of more than about 475 ml, more preferably more than 500 ml, or most preferably greater than about 550 ml.

DETAILED DESCRIPTION OF THE INVENTION

Figure 1A:
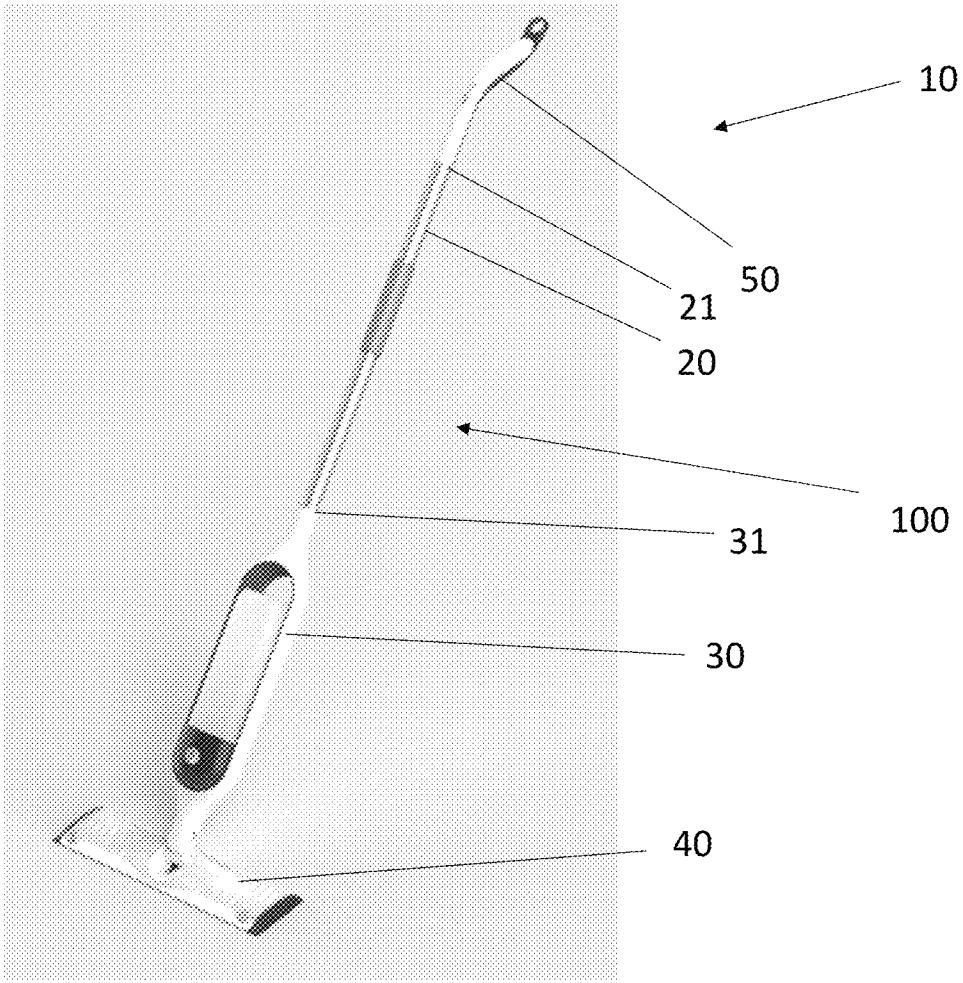
FIG. 1A shows a perspective view of a cleaning apparatus in accordance with the present disclosure.

The cleaning apparatus of the present disclosure can accommodate low vertical clearances while also providing the user with a sufficient volume of cleaning solution. The cleaning apparatus of the present disclosure comprises a support member having a first portion and a second portion. The first portion has a length, a first end and an opposing second end. The first portion of the support member is the portion which is primarily utilized by the user for manipulation of the cleaning apparatus during use.

The first portion may comprise a handle disposed on the first end of the first portion. The handle may be unitarily formed with the first portion or may be a discrete material attached to the first portion. The handle may be pivotably connected to the first portion. Alternatively, the handle may be rigidly mounted thereto. A handle may be provided to allow for a more ergonomic experience. Specifically, the provision of the handle can allow for ergonomic manipulation of the cleaning apparatus.

The second portion of the support member has a first transition disposed on the second end of the first portion and a second transition spaced from the first transition. A first support and a second support join the first transition and the second transition. And a cleaning head is moveably attached to the second transition.

The cleaning head may be moveably mounted with respect to the second transition such that the support member, including the first portion and second portion, can pivot with respect to the cleaning head in a longitudinal direction. Additionally, the cleaning head may be moveably mounted with respect to the second transition such that the support member, including the first portion and the second portion, can pivot with respect to the cleaning head in a transverse direction or generally parallel thereto. The movement of the support member with respect to the cleaning head in both the longitudinal direction and the transverse direction are disclosed in additional detail hereafter.

The cleaning head may comprise a generally upwardly facing top surface and a bottom surface opposed thereto. The cleaning head may have a front edge, an opposing back edge and two side edges joining the front edge and the opposing back edge. A long axis of the cleaning head is located at the centerline (and extending generally parallel with the front edge and/or opposing back edge) along the long dimension of the cleaning head. A short axis of the cleaning head is located at the centerline of the head parallel to its side edges and running from the front edge to the back edge.

For the sake or orientation, during use of the cleaning apparatus of the present disclosure, movement of the cleaning head forward, i.e. the front edge and long axis of the cleaning head being generally perpendicular to the direction of movement, the support member can generally move in a longitudinal direction. In contrast, movement of the cleaning head from side to side, i.e. the front edge and long axis of the cleaning head being generally parallel to the direction of movement, the support member generally moves in a transverse direction.

Additionally, the support member may comprise a first portion height. With the bottom surface of the cleaning head completely flat against a plane, the first portion height is the greatest perpendicular extent of the first portion of the support member away from the plane while the support member is oriented in a longitudinal direction and rotated in the direction of the back edge of the cleaning head and toward (but not through) the plane as far as possible. While held in this same configuration, the vertical height is the greatest perpendicular extent from the second portion of the support member away from the plane. While also held in this same configuration, the support member length is the projection in the plane of the distance between the end of the first portion distal from the cleaning head to the intersection of the short axis and back edge of the cleaning head.

The cleaning apparatus of the present disclosure further comprises a liquid management system disposed, at least in part, between the first transition and second transition. The liquid management system comprises a reservoir receiver. The reservoir receiver may be in liquid communication with at least one liquid reservoir. The at least one liquid reservoir may be removably attached to the reservoir receiver or may be non-removably attached to the reservoir receiver.

It is worth noting that one possible solution to accommodate lower vertical clearances is to reduce the volume of the liquid reservoir that the cleaning apparatus utilizes. However, it is believed that such configurations may frustrate the user experience in the way of difficult maneuverability. So, the cleaning apparatuses of the present disclosure may accommodate liquid reservoirs having an ability to contain a liquid volume of greater than about 475 ml, more preferably greater than about 500 ml or most preferably greater than about 550 ml, specifically reciting all values within these ranges and any ranges created thereby. For example, the cleaning apparatuses of the present disclosure may accommodate liquid reservoirs having a liquid volume of from about 475 ml to about 800 ml, more preferably from about 500 ml to about 800 ml or most preferably from about 550 ml to about 800 ml, specifically reciting all values within these ranges and any ranges created thereby. In one specific example, the bottle volume can be about 750 ml.

Regardless of whether the liquid reservoir is removably attached to the reservoir receiver, the liquid reservoir may be re-fillable. Or the liquid reservoir may not be re-fillable but instead may be replaceable. As an example, a first liquid reservoir may be attached to the reservoir receiver and upon use of all of the contents, substantially all of the contents within the liquid reservoir, or simply a desire to change the first liquid reservoir for a second, the first liquid reservoir may be removed and replaced by the second liquid reservoir.

The liquid reservoir is disposed, at least in part, between the first transition and the second transition. Where the liquid reservoir is non-removable, the first transition, second transition, first support and second support, may be integrally formed with the liquid reservoir. Where the liquid reservoir is removable, the first support and the second support may comprise detents which provide support for the liquid reservoir. For example, the guidance detents can provide support such that the liquid reservoir has limited mobility in the transverse direction. The detents can be any suitable shape, for example, bumps, ridges, latches, the like or combinations thereof.

It is worth noting that the detents can be any suitable shape and length. However, in order to facilitate removal as well as replacement of the liquid reservoir, the detents may be about 60 percent of the length of the liquid reservoir or less, more preferably about 50 percent or less or most preferably about 40 percent or less, specifically reciting all values within these ranges and any ranges created thereby. For example, the detents may have a length from between about 1 percent to about 60 percent, more preferably from about 1 percent to about 50 percent or most preferably from about 1 percent to about 40 percent of the length of the liquid reservoir. In one specific example the detents may have a length of about 42 percent of the length of the liquid reservoir.

Where the liquid reservoirs are removably attached to the reservoir receiver, the cleaning apparatus may comprise a release. The release may comprise a push button mechanism, or other releasable latching mechanism, to allow removal of the liquid reservoir from the reservoir receiver, the first support and second support, the first transition and/or the second transition. Activation of the release may be converted to a lateral motion of a moving member. The moving member can engage a complementary portion of the liquid reservoir in a first position and disengages from such portion in a second position. The manipulation of the release can engage and/or disengage the moving member from the complementary portion of the liquid reservoir.

Additionally, the cleaning apparatus of the present disclosure may comprise a single liquid reservoir or may comprise a plurality of reservoirs. The plurality of reservoirs may contain the same fluid therein, thus providing greater quantity than a single reservoir. Alternatively, the reservoirs may comprise different fluids. The different fluids may be dispensed sequentially, or a particular fluid may be dispensed as needed for a particular task. If the reservoirs comprise different fluids, the fluids may be co-dispensed, to allow mixing at the point of use on the target surface. Where a plurality of liquid reservoirs is utilized, the cumulative liquid volume may be similar to what was described heretofore regarding the liquid reservoir volume.

Referring back to the first support and the second support, particularly where the liquid reservoir is removable, the cleaning apparatus may be provided initially (on shelf) without a liquid reservoir connected to its reservoir receiver. One or more liquid reservoirs may be included in the package with the cleaning apparatus.

Where the liquid reservoir is not connected to the reservoir receiver, a void may exist between the first support and the second support. The void may be sized such that the liquid reservoirs can be connected and removed from the reservoir receiver. For example, once the liquid reservoir is connected to the reservoir receiver, a space may exist between a top surface of the liquid reservoir and the first transition which allows for easy grasping of the liquid reservoir by a user. In one particular example, the space between the transition and the top surface of the liquid reservoir may be about 20.4 percent of a length of the void. In yet another example, a difference between the width of the void and a width of the liquid reservoir may be about 14 percent of a width of the void.

Despite the accommodation of the large capacity liquid reservoirs of the cleaning apparatuses of the present disclosure, the inventors have surprisingly found that the support member has a large range of motion in the longitudinal direction specifically in addressing low vertical clearance. For example, in the longitudinal direction, the support member can exhibit a longitudinal angle of about six degrees or less with respect to a horizontal plane or more preferably 5.8 degrees or less from the horizontal plane, specifically reciting all values within these ranges and any ranges created thereby. For example, the support member may exhibit a longitudinal angle of from between about 2 degrees to about 6 degrees or more preferably from about 2 degrees to about 5.8 degrees, specifically reciting all values within these ranges and any ranges created thereby. In one specific example, the angle of support member with respect to the horizontal plane may be about 5.6 degrees. As used herein, the longitudinal angle is defined as the inverse tangent (arctan) of the ratio of the first portion height to the support member length.

It is worth noting that the angle exhibited by the support member is only part of the consideration for vertical clearance. As noted, the second portion may comprise, a liquid reservoir in the reservoir receiver and the cleaning head. These components take up vertical space which may not necessarily be accounted for in the measurement of the longitudinal angle. So, vertical height of the cleaning apparatus when the support member is at its smallest longitudinal angle with respect to the horizontal plane may also be important. Regarding the cleaning apparatuses of the present disclosure, the vertical height of the cleaning apparatus can be less than about 110 mm, more preferably less than about 100 mm or most preferably less than about 95 mm, specifically reciting all values within these ranges and any ranges created thereby. For example, the vertical height of the cleaning apparatuses of the present disclosure can be from about 70 mm to about 110 mm, more preferably from about 70 mm to about 100 mm or most preferably from about 70 mm to about 95 mm, specifically reciting all values within these ranges and any ranges created thereby. In one specific example, the vertical height may be about 88 mm.

Still another feature of cleaning implements which may impact the vertical height of a cleaning implement is the first portion height. For the cleaning apparatuses of the present disclosure, the first portion height may be less than about 120 mm more preferably less than about 110 mm, specifically reciting all values within these ranges and any ranges created thereby. For example, the cleaning apparatuses of the present disclosure may comprise a first portion height of from about 95 mm to about 120 mm, more preferably from about 95 mm to about 110 mm, specifically reciting all values within these ranges and any ranges created thereby. In one specific example, the first portion height may be about 104 mm.

Additional ways to accommodate a lower angle, aside from lowering the volume of the liquid reservoir is to lengthen the support member of the cleaning implement. However, while a longer support member may allow for lower angles, the longer support member may increase the difficulty of user manipulation during use. It is believed that support members having a length of more than about 1400 mm can make the manipulation of the cleaning apparatus more difficult for the user. So, the length of the support member for the cleaning apparatuses of the present disclosure can be less than about 1400 mm, more preferably less than about 1200 mm, or most preferably less than about 1100 mm, specifically reciting all values within these ranges and any ranges created thereby. For example, the length of the support member for the cleaning apparatuses of the present disclosure may be from about 1000 mm to about 1400 mm, more preferably from about 1000 mm to about 1200 mm or most preferably from about 1000 mm to about 1100 mm, specifically reciting all values within these ranges and any ranges created thereby. In one specific example, the cleaning apparatus of the present disclosure may comprise support member length of about 1060 mm.

It is worth noting that in order to create a lower vertical height as well as a lower longitudinal angle, the liquid reservoir along with the reservoir receiver, may be flattened such that they have a profile in the transverse direction which is quite large compared to its profile in the longitudinal direction. However, such constructions while potentially accommodating low vertical clearance concerns when viewed from angular mobility in the longitudinal direction, may unfortunately create clearance issues when viewed from the transverse direction. In that regard, the cleaning apparatuses of the present disclosure, the support member thereof, may exhibit a transverse angle of about 30 degrees or less with respect to the horizontal plane, more preferably about 20 degrees or less, or most preferably about 15 degrees or less, specifically reciting all values within these ranges and any ranges created thereby. For example, the support member may exhibit a transverse angle with respect to the horizontal plane of from between about 5 degrees to about 30 degrees, more preferably from about 5 degrees to about 20 degrees or most preferably from about 5 degrees to about 15 degrees in the transverse direction, specifically reciting all values within these ranges and any ranges created thereby. In one particular example, the support member may exhibit a transverse angle from about 9 degrees with respect to the horizontal plane.

Similar to the longitudinal angle, the transverse angle has the bottom surface of the cleaning head completely flat against a plane, the support member height is the greatest perpendicular extent of the support member away from the plane while the support member is oriented in a transverse direction and rotated in the direction of one of the side edges of the cleaning head and toward (but not through) the plane as far as possible. While also held in this same configuration, the transverse support member length is the projection in the plane of the distance between the end of the first portion distal from the cleaning head to the intersection of the short axis and the long axis of the cleaning head. As used herein, the transverse angle is defined as the inverse tangent (arctan) of the ratio of the first portion height to the transverse support member length.

Angles in the longitudinal direction, transverse direction, vertical height, first portion height, support member height and length of support member for the cleaning apparatus can be collected via any suitable linear measurement device. As an example, a Mitutoyo Coordinate Measuring Machine (CMM), Crysta-Plus Model #M574 or equivalent may be utilized.

In addition to the reservoir receiver, the liquid management system may further comprise pump in liquid communication with the reservoir receiver and the liquid reservoir. Note that where the liquid reservoir is removable, the pump is only in liquid communication with the liquid reservoir when the liquid reservoir is attached to the reservoir receiver. Additionally, the pump is in liquid communication with one or more nozzles/outlets. The nozzles/outlets may be disposed on the cleaning head and/or any other suitable location.

The first portion, e.g. the handle, may comprise an actuator for operating the pump. For example, the actuator may be operatively connected to a pump such that depression of the actuator can energize a motor which drives the pump thereby causing liquid from a liquid reservoir connected to the reservoir receiver to exit the one or more outlets and/or nozzles. It is worth noting that the motor may be in electrical communication with a power source, e.g. one or more batteries, line current or combinations thereof. The one or more batteries may be rechargeable. The batteries and/or pump may be disposed in the cleaning head, support member or combinations thereof. For example, the batteries may be disposed on the support member, while the motor and pump are disposed on the cleaning head, or all three components may be disposed on the support member or head.

Alternatively, the pump may be manual and require the actuator to be activated, displaced or otherwise moved, thereby activating the pump. Or the pump may comprise an air pump which can be utilized to pressurize the liquid reservoir. An actuator in the first portion can open a valve allowing liquid to flow to the one or more nozzles and/or outlets. A cleaning apparatus having a replaceable reservoir and powered pump may be made according to the teaching of commonly assigned U.S. Pat. Nos. 5,888,006; 5,988,920; 6,142,750; 6,206,058; 6,321,941; 6,328,543; 6,386,392; 6,491,069; 6,579,023; 6,814,519; 6,842,936; 7,172,099 and/or 7,187,537.

Still in other forms, the cleaning apparatuses of the present disclosure may not comprise a motor and a pump. In such configurations, the cleaning apparatus may be capable of receiving pressurized liquid reservoirs. Further in such constructions, an actuator easily accessible by the operator of the cleaning apparatus, may be in mechanical communication with the liquid reservoir such that depression (or other activation of the actuator) causes the pressurized contents in the liquid reservoir to be provided to the one or more outlets/nozzles. Such liquid reservoirs may comprise any suitable means of pressurization, e.g. via hydrocarbon propellent, nitrogen gas, and the like.

It is worth noting that the placement of liquid reservoir, particularly when full of liquid can greatly impact the maneuverability of the cleaning apparatus. For example, the support member can have an overall length. Similarly, the first portion may comprise a first portion length and the second portion may comprise a second portion length.

One potential way to accommodate low vertical clearances is to move the liquid management system closer to the first portion and/or place the liquid management system solely in the first portion. However, doing so can negatively impact the experience of the user. For example, particularly where full liquid reservoirs are present, the more proximal the liquid reservoirs are to the handle, the more of the weight of these components the user has to bear. So, placing the liquid management system, i.e. liquid reservoirs, in the first portion may negatively impact the user experience of the cleaning apparatus.

In order to accommodate this, the first portion length is at least about 30 percent of the overall length of the support member, more preferably at least 40 percent of the overall length of the support member or most preferably at least 50 percent of the overall length of the support member. For example, the first portion length is between 30 percent and 70 percent of the overall length of the support member, more preferably between 40 percent and 60 percent of the overall length of the support member or most preferably between 50 percent and 60 percent of the overall length of the support member.

Additionally, the centroid of internal space of the liquid reservoir can be of import. For example, for the cleaning apparatus of the present disclosure, the centroid of the interior space of the liquid reservoir may be disposed in a vertical plane which is disposed within about 40 mm or less from a bisecting plane of the support member or more preferably within 30 mm or less from the bisecting plane or most preferably within about 20 mm or less from the bisecting plane, specifically reciting all values within these ranges and any ranges created thereby. For example, the centroid of interior space of the liquid reservoir may be longitudinally spaced from the bisecting plane by about from 0 mm to about 40 mm, more preferably about 0 mm to about 30 mm or most preferably about 0 mm to about 20 mm, specifically reciting all values within these ranges and any ranges created thereby. For the sake of clarity, the bisecting plane is oriented vertically and bisects the width of the first transition and/or second transition when the support member is oriented vertically.

It is believed that where the centroid of interior space of the liquid reservoir, particularly when full, is disposed outside of those ranges when operatively connected to the reservoir receiver, the cleaning apparatus becomes more difficult to operate. For example, the weight of the liquid reservoir can influence the position of the support member, particularly when turning/pivoting the cleaning apparatus. This influence of the weight of the liquid reservoir can negatively impact the user experience. A variety of data for a variety of cleaning implements was measured regarding some of the metrics discussed previously. That data is provided in Table 1.

TABLE 1

| | Longitudinal Angle (degree) | Vertical Height (mm) | First portion height (mm) | Liquid Reservoir Volume (ml) | Length of support member (mm) |
|---|---|---|---|---|---|
| Sample 1 | 3.7 | 109 | 101 | 450 | 1548 |
| Sample 2 | 4.1 | 128 | 114 | 600 | 1094 |
| Sample 3 | 5.2 | 89 | 102 | 350 | 1123 |
| Sample 4 | 6.9 | 156 | 136 | 650 | 1104 |
| Sample 5 | 7.1 | 108 | 132 | 750 | 1066 |
| Sample 6 | 7.4 | 115 | 144 | 750 | 1126 |
| Sample 7 | 20 | 244 | 525 | 450 | 1099 |
| Sample 8 | 23 | 190 | 361 | 750 | 1071 |
| Sample 9 | 6.5 | 115 | 119 | 1000 | 1046 |
| Sample 10 | 5.8 | 122 | 114 | 500 | 1137 |
| Sample 11 | 24 | 177 | 456 | 1250 | 1071 |
| Example 1 | 5.6 | 88 | 104 | 750 | 1060 |

Sample 1 is available from Itworks™ and sold as the Flexible Spray Mop.

Sample 2 is available from Clorox™ and sold as the Ready Flip Mop.

Sample 3 is available from Amazon™ and sold as the Basic Mop.

Sample 4 is available from Rubbermaid™ and sold as the Reveal Spray™ Microfiber Floor Mop.

Sample 5 is available from Casabella™ and sold as the Radius Spray Mop.

Sample 6 is available from O-Cedar™ and sold as the Promist Max Microfiber spray mop.

Sample 7 is available from Oxo™ and sold as the Good Grips Mop.

Sample 8 is available from Leifheit™ and sold as the Pico Spray Mop.

Sample 9 is available from Bona™ and sold as the Wood Floor Spray Mop.

Sample 10 is available from Finnhomy™ and sold as the Spray Mop.

Sample 11 is available from Swiffer™ and sold as the Wet Jet™.

Example 1 is a cleaning apparatus constructed in accordance with the present disclosure.

Figure 1B:
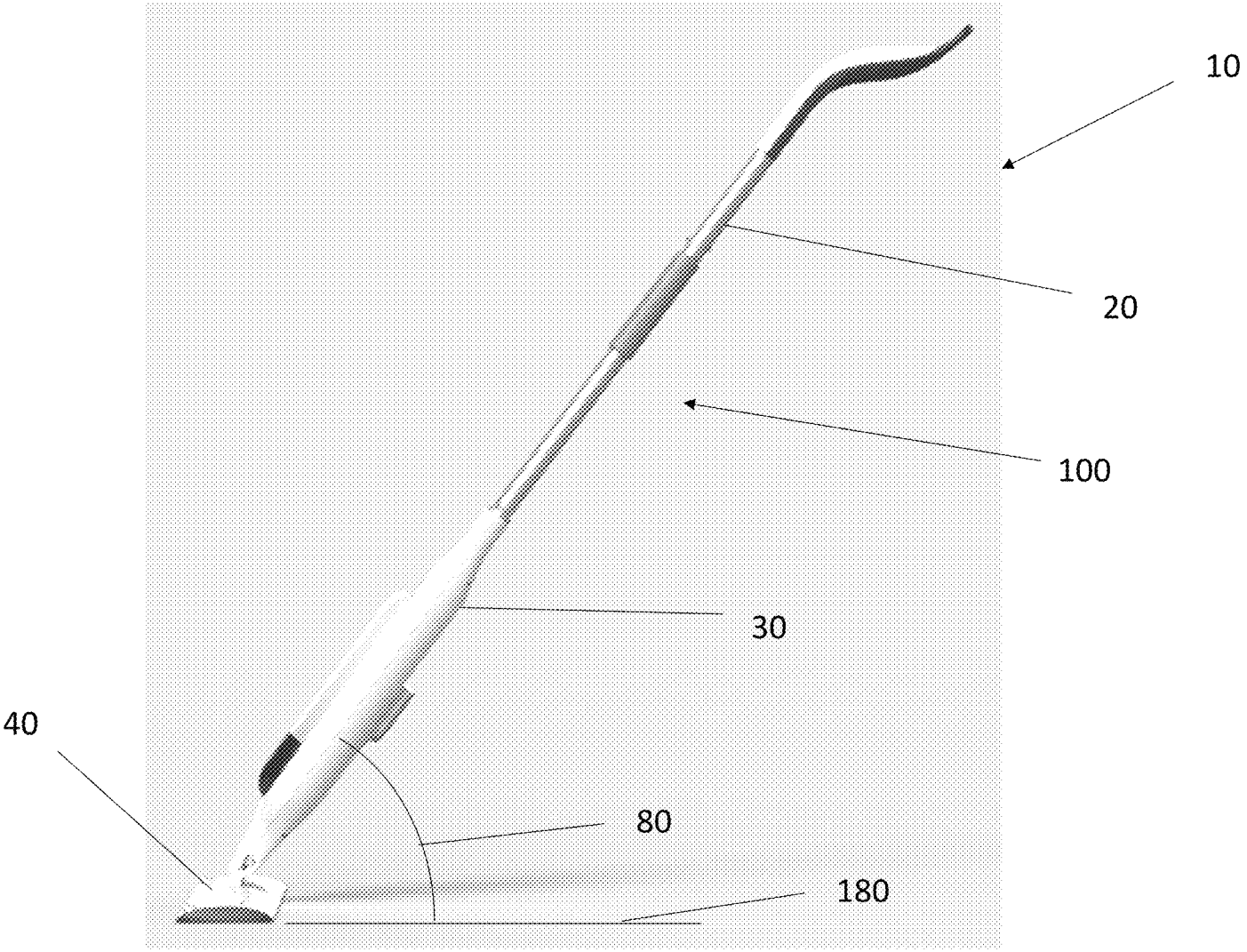
FIG. 1B shows a side view of the cleaning apparatus of FIG. 1A.
Figure 1C:
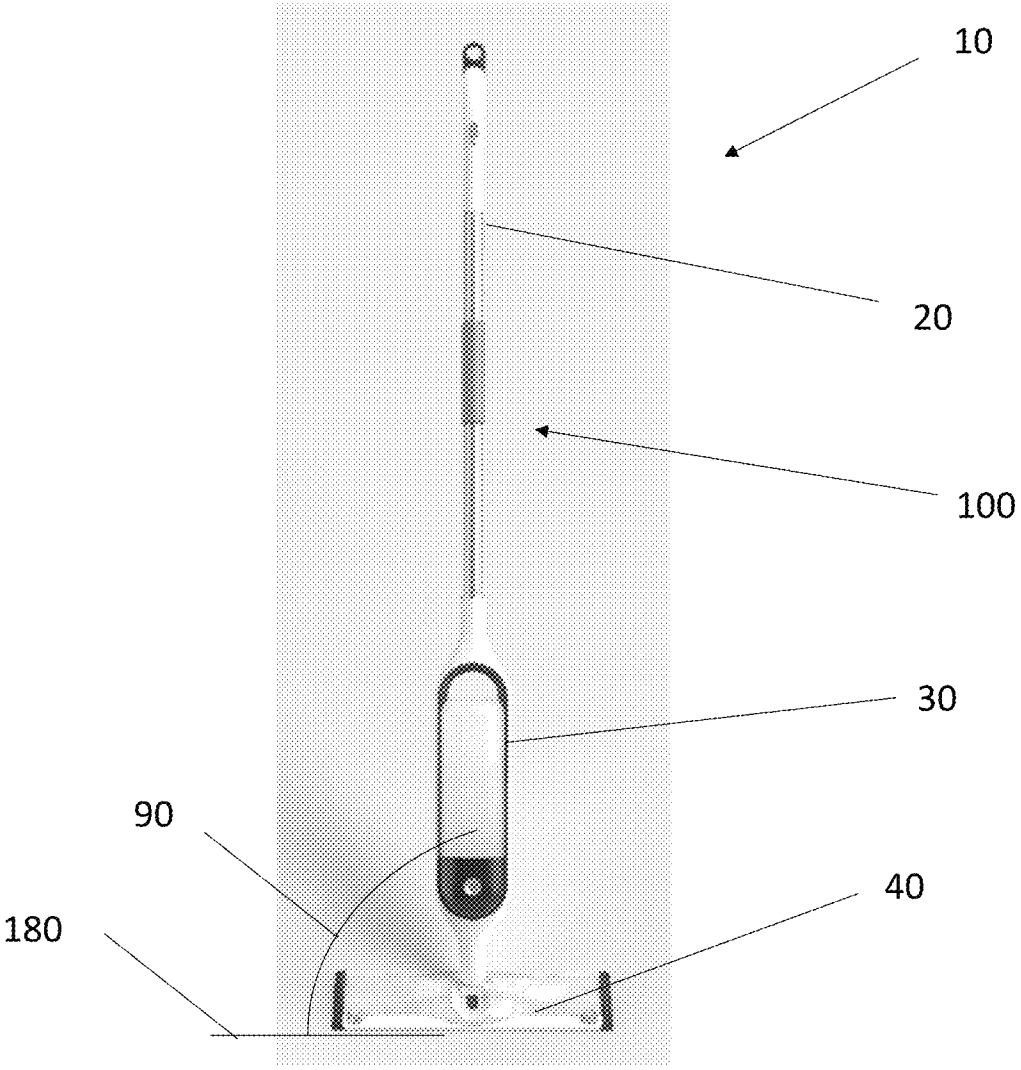
FIG. 1C shows a front view of the cleaning apparatus of FIG. 1A.

Reference will now be made to the Figures to facilitate additional understanding of the metrics and disclosure thus far. FIGS. 1A-1C shows a cleaning apparatus 10 in accordance with the present disclosure. As shown, the cleaning apparatus 10 comprises a support member 100 which comprises a first portion 20 and a second portion 30. As shown a handle 50 may be comprised by the first portion 20 and be disposed on a first end 21 of the first portion 20. The second portion 30 may be disposed on a second end 31 of the first portion 20. Additionally, the cleaning apparatus 10 comprises a cleaning head 40 which is attached to the second portion 30.

A longitudinal angle 80 of the support member 100 with respect to a horizontal plane 180 is shown. As noted previously, the cleaning apparatuses of the present disclosure can exhibit small angles 80 to accommodate low vertical clearance. Additionally, in this position, the cleaning apparatuses of the present disclosure also exhibit a small vertical height, again allowing for the cleaning apparatuses of the present disclosure to accommodate low vertical clearances.

Referring now to FIG. 1C, a transverse angle 90 of the support member with respect to a horizontal plane 180 is shown. As noted previously, the cleaning apparatuses of the present disclosure can exhibit small angles 90 to accommodate low vertical clearance.

Vertical clearance issues were discussed previously regarding the profile of the liquid management system and/or liquid reservoir. Additionally, it is worth noting that it is believed that there is a tradeoff between the vertical height in a longitudinal direction versus that of the transverse direction. Namely, it is believed that the smaller the longitudinal angle 80 desired and/or the smaller the vertical height desired, a corresponding increase in the transverse angle 90 may occur.

Figure 2:
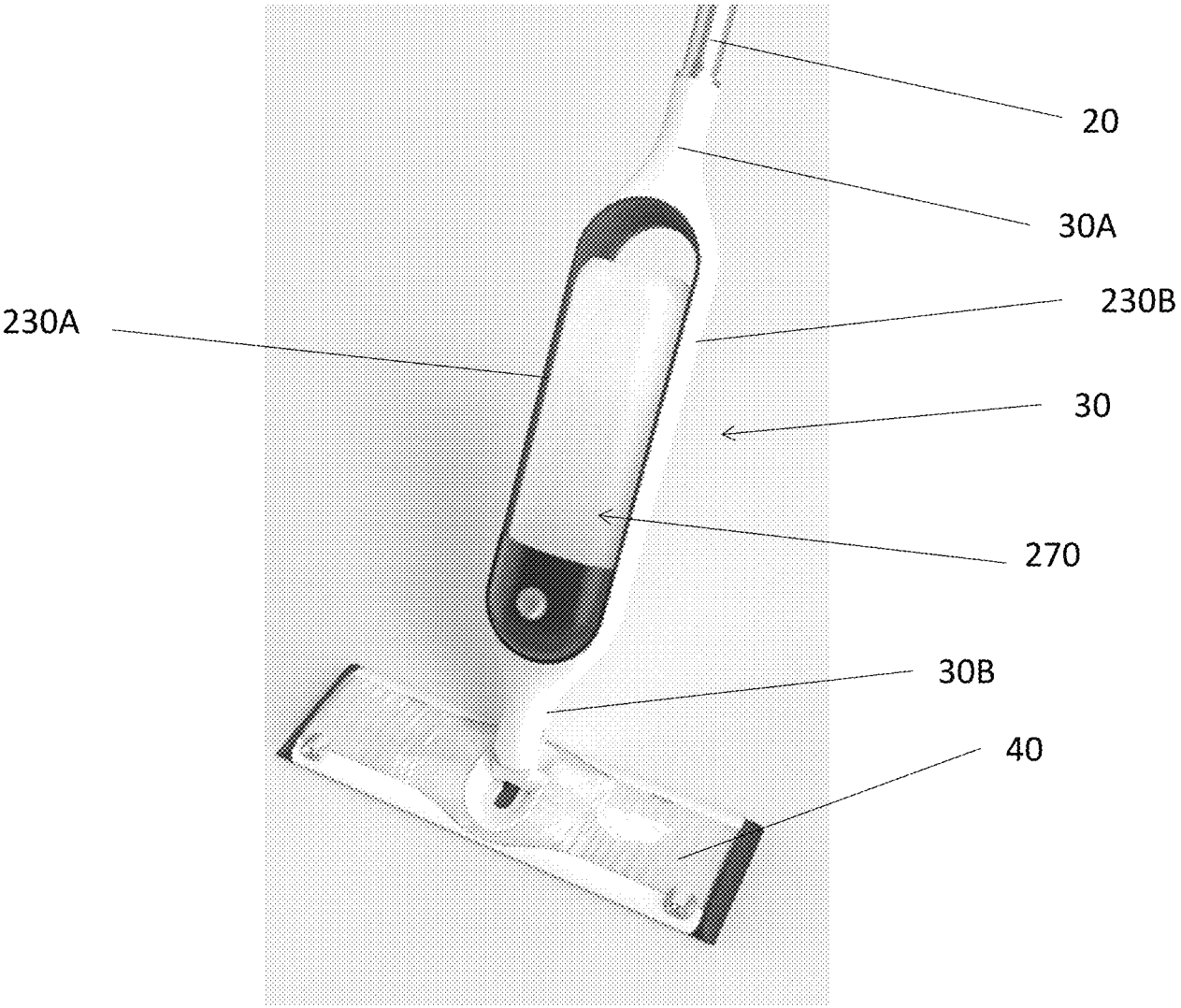
FIG. 2 shows a close up of a second portion of the cleaning apparatus of FIG. 1A.

Referring now to FIG. 2, a close up of the second portion 30 is shown. The second portion 30 may comprise a first transition 30A which is disposed on a second end of the first portion 20. As shown, the first transition 30A can flare out in generally the transverse direction as the transition moves from the second end of the first portion 20 toward the cleaning head 40. A second transition 30B is disposed opposite the first transition 30A. Similar to the first transition 30A, the second transition 30B can flare outward generally in the transverse direction and narrow as the second transition 30B moves toward the cleaning head 40.

The cleaning head 40 may be movably connected to the second transition 30B. For example, the cleaning head 40 can be pivotably connected to the second transition 30B such that the support member (item 100 shown in FIGS. 1A-1C), can move in the longitudinal direction and transverse direction with respect to the cleaning head 40.

Still referring to FIG. 2, as shown, a first support 230A and a second support 230B are disposed between the first transition 30A and the second transition 30B. As shown, the first support 230A and the second support 230B can join the first transition 30A and the second transition 30B. For example, the first support 230A and the second support 230B may be integrally formed with the first transition 30A and/or the second transition 30B. Similarly, it is worth noting that the first transition 30A, the first support 230A, the second support 230B, and/or the second transition 30B, may comprise the same material or different material than that of the first portion 20.

Figure 3:
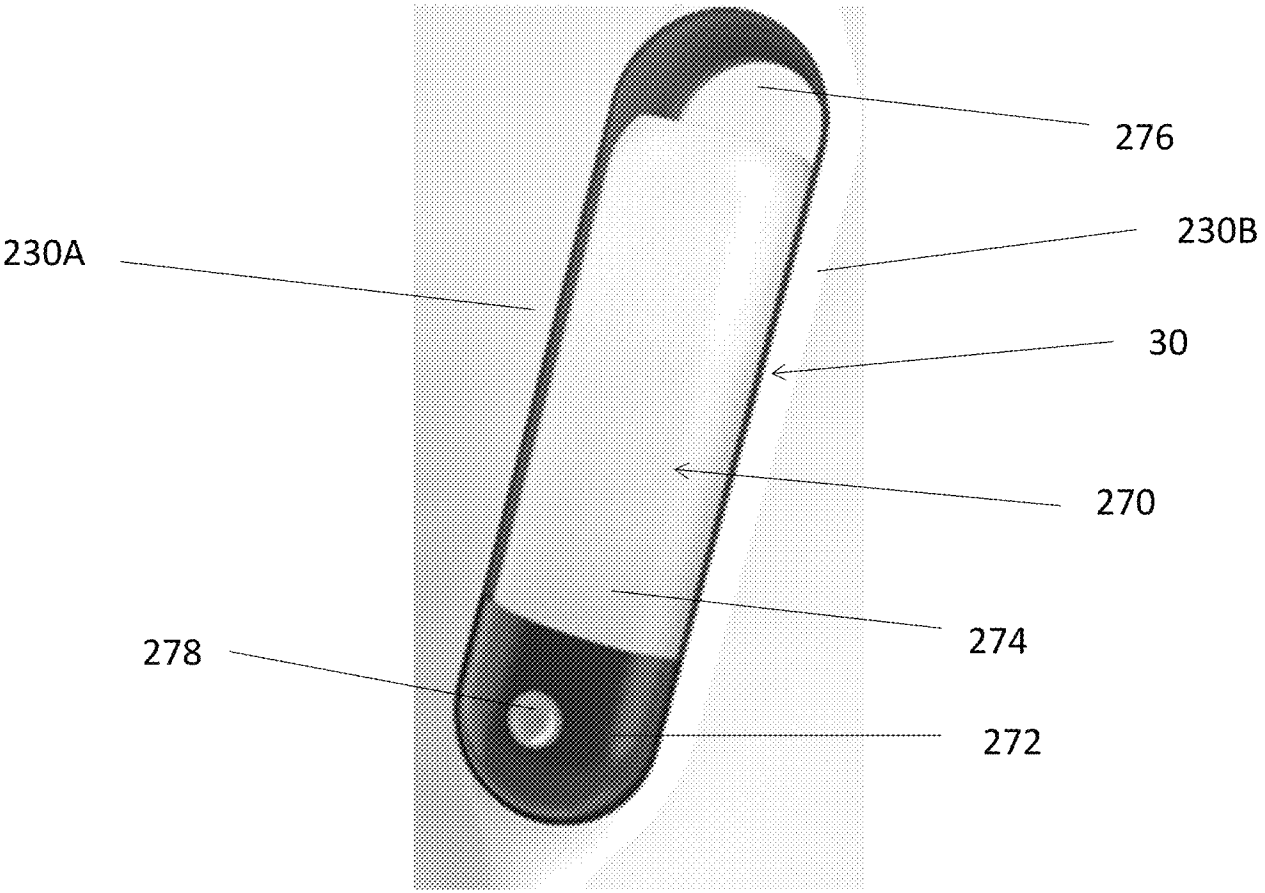
FIG. 3 shows a liquid management system in accordance with the cleaning apparatuses of the present disclosure.

Referring now to FIGS. 2 and 3, a liquid management system 270 is disposed, at least in part, between the first transition 30A and the second transition 30B. The liquid management system 270 may comprise a reservoir receiver 272 and a liquid reservoir 274. As mentioned previously, the liquid reservoir 274 may be refillable or non-refillable. And, as also noted previously, the liquid reservoir 274 may be removably attached to the reservoir receiver 272. So, whether the liquid reservoir 274 is refillable or not, the liquid reservoir 274 may be removed from the reservoir receiver 272 as desired/needed and either refilled and reinstalled into the reservoir receiver 272 or replaced and a different liquid reservoir is attached to the reservoir receiver.

Where the liquid reservoir 274 is removably attached to the reservoir receiver 274, a release member 278 may be provided to facilitate removal of the liquid reservoir 274 from the reservoir receiver 272. For example, as shown the release member 278 may be disposed on the reservoir receiver 272. However, the release mechanism can be provided in any suitable location.

Additionally, for those forms where the liquid reservoir is removable, the liquid management system 270 may similarly comprise a void 276 which can facilitate grasping of the liquid reservoir 274 by the user. As shown, the void 276 may be disposed near an end of the liquid reservoir 274 which is most proximal to the first portion (item 20 in FIGS. 1A-2). However, in some forms, a void may be provided between the first support 230A and the second support 230B in addition to or independently of the void 276. Also, in some forms, the liquid reservoir 274 may be provided with a handle or an indentation which facilitate grasping of the liquid reservoir 274 by the user.

Still for those forms where the liquid reservoir 274 is removable, one or more detents may be provided on an inner surface of the first support 230A and the second support 230B. These detents can help provide the liquid reservoir 274 with stability when attached to the reservoir receiver 272. The size and shape of the detents was discussed previously.

For those forms where the liquid reservoir 274 is not replaceable, the first support 230A and the second support 230B may be integrally formed with the liquid reservoir 274. For example, the first support 230A and the second support 230B may form sides of the liquid reservoir 274. Similarly, the first transition 30A and the second transition 30B may form a top and a bottom of the liquid reservoir 274, respectively.

Regardless of whether the liquid reservoir is removable, the inventors have surprisingly found that conventional cleaning apparatuses do not utilize the space/volume of the second portion of the support member. Specifically, the second portion of the support member often does not perform any additional function other than as a support member. However, in the cleaning apparatuses of the present disclosure the second portion 30 of the support member can be part of the liquid management system 270, i.e. where the first support 230A and the second support 230B are integrally formed with the liquid reservoir 274.

Figure 4:
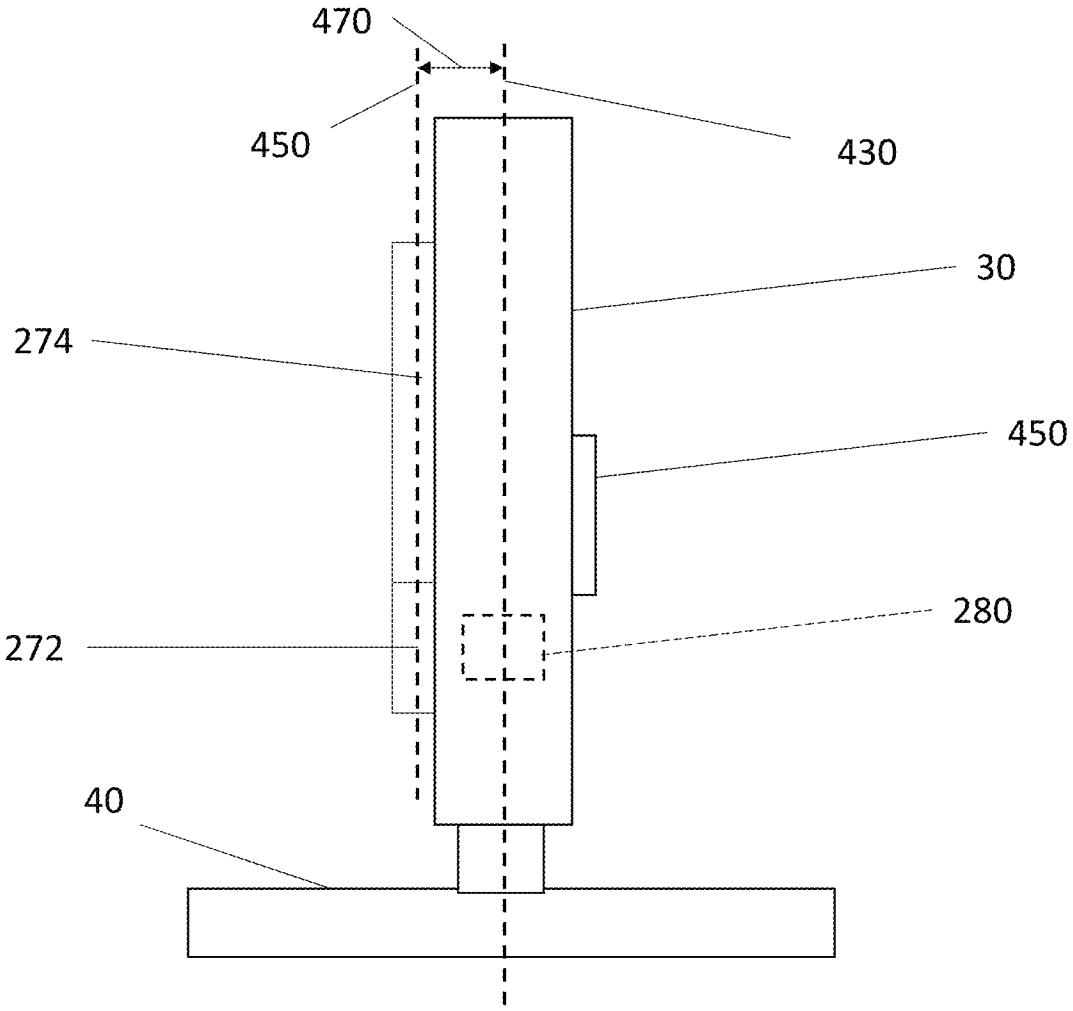
FIG. 4 is a schematic representation showing a side view of a second portion of the cleaning apparatuses of the present disclosure.

Referring now to FIG. 4, as noted previously, the liquid reservoir 274 has a centroid of interior space located in a vertical plane 450 which is within a distance 470 from a bisecting plane 430. It is believed that when the centroid of interior space of the liquid reservoir 274 is outside of this distance, the cleaning apparatus may become too difficult to manipulate during cleaning.

Figure 5:
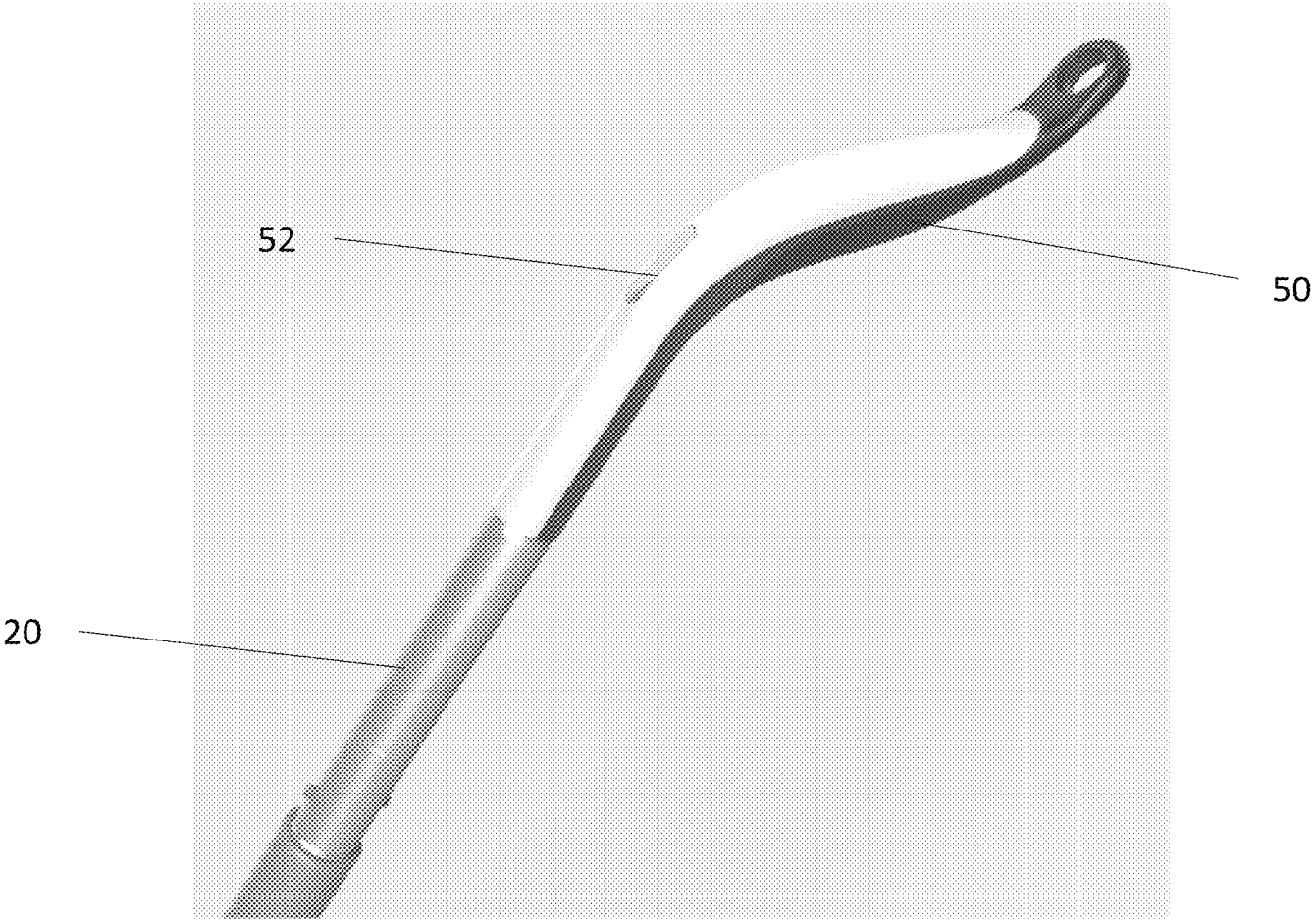
FIG. 5 shows a close up view of a first portion of the cleaning apparatus of FIG. 1A.

Referring now to FIGS. 3-5, as noted regarding FIG. 1A, the cleaning apparatus of the present disclosure may comprise a handle 50. The handle 50 may comprise a switch 52 which activates a pump 280 which is part of the liquid management system 270. As noted, where the pump is electrical, the switch 52 may be in electrical communication with a power source 450, e.g. a batter pack. And the power source 450 may be in electrical communication with a motor that operates the pump. Upon activation, e.g. via depression or displacement, of the switch 52, the power source 450 may provide energy to the motor. The pump may then draw liquid from the liquid reservoir 274 and send it to one or more nozzles/outlets on the cleaning head 40.

It is worth noting that the power source 450 may comprise a batter pack having one or more batteries. The battery pack may be rechargeable. Alternatively, the power source 450 may comprise an electrical cord which draws power from an electrical outlet.

Still other forms are contemplated where the pump is mechanically operated rather than electrical. In such forms, the switch 52 may be in mechanical communication with the pump such that activation of the switch 52, e.g. depression or displacement, operates the pump such that liquid is drawn from the liquid reservoir 274 and provided to one or more nozzles/outlets on the cleaning head 40.

Figure 6:
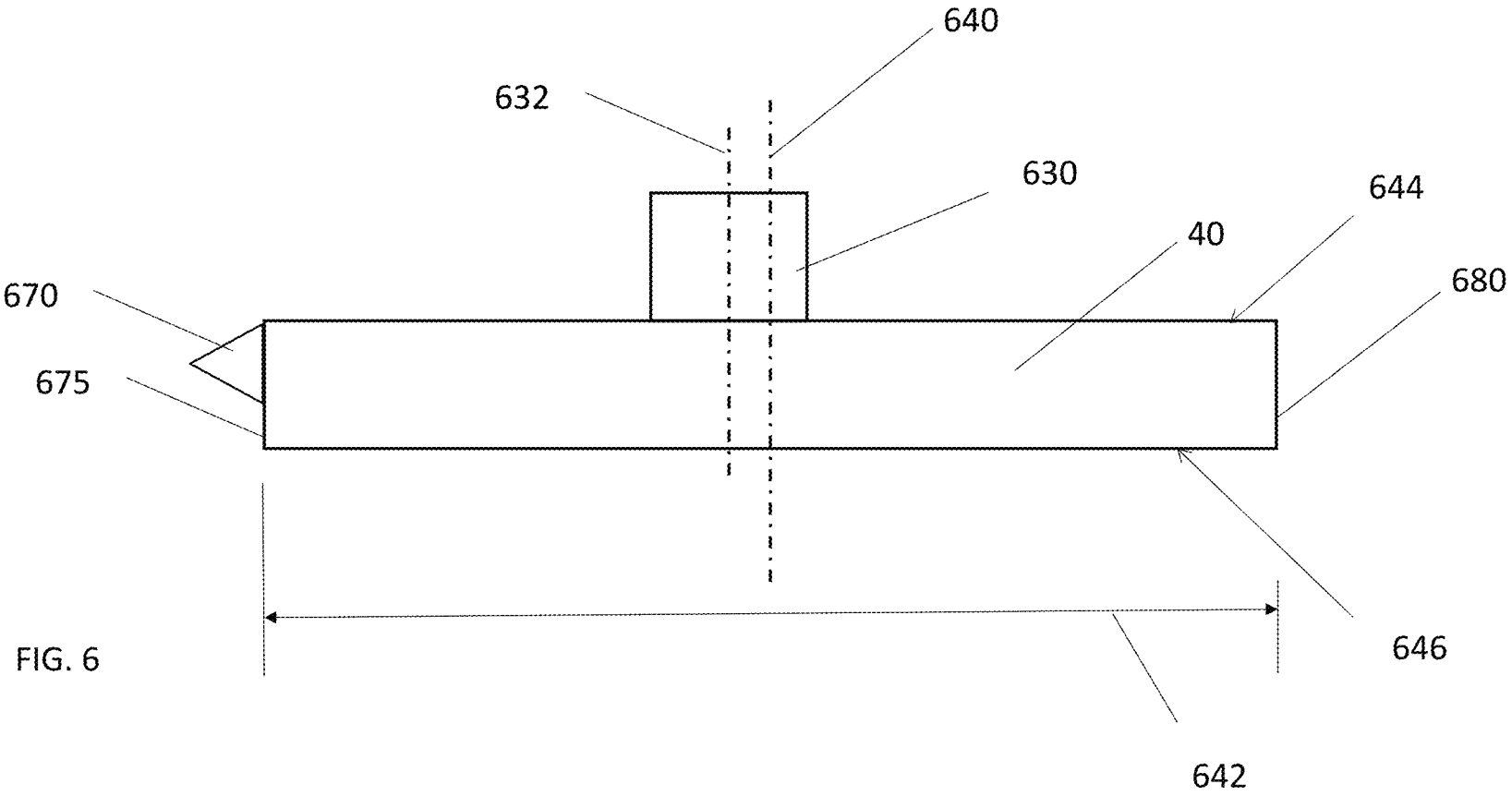
FIG. 6 is a schematic representation showing a cleaning head in accordance with the cleaning apparatuses of the present disclosure.

Referring now to FIG. 6, a schematic representation of the cleaning head 40 is provided. As shown, the cleaning head 40 comprises a width 642 defined by a front edge 675 and an opposing back edge 680, wherein the width is generally parallel to the longitudinal direction. A cleaning head longitudinal centerline 640 may bisect the width 642 of the cleaning head 40. Additionally, as shown, a cleaning head connection 630, which moveably, e.g. pivotably, connects the cleaning head 40 to the second portion, may comprise a cleaning head connection centerline 632. The cleaning head connection centerline 632 can extend through a center point of the axis of rotation, e.g. pivot axis, of the support member in the longitudinal direction with respect to the cleaning head 40. As shown, the cleaning head connection centerline 632 may be offset from the cleaning head centerline 640. The offset of the cleaning head connection centerline 632 may be toward the one or more nozzles and/or outlets 670. In offsetting the cleaning head connection centerline 632 from the cleaning head centerline 640, the cleaning head 40 can have less of a tendency to flip during use.

The offset of the cleaning head connection centerline 632 with respect to the cleaning head centerline 640 can be based on the overall width 642 of the cleaning head 40. This offset can be dependent on the overall width 642 of the cleaning head 40. For example, the offset may be about 1 percent or greater than the overall width 642 of the cleaning head 40, more preferably, about 3 percent or greater or most preferably about 5 percent or more than the overall width 642 of the cleaning head 40, specifically reciting all values within these ranges and any ranges created thereby. For example, the offset may be from between about 1 percent to about 15 percent of the overall width 642 of the cleaning head, more preferably from about 3 percent to about 10 percent of the overall width 642 or most preferably from about 5 percent to about 9 percent of the overall width 642 of the cleaning head, specifically reciting all values within these ranges and any ranges created thereby.

Although not shown, the cleaning head 40 may comprise locking members which help to hold a cleaning sheet in place. These locking members may be disposed on an upper surface 644 and/or a lower surface 646 of the cleaning head 40. Upon wetting the target surface with the fluid from the liquid reservoir, the user may remove debris with a cleaning sheet. The cleaning sheet may be removably attached to the head, and particularly to the underside of the head. Suitable cleaning sheets include nonwovens, microfiber, yarns, formed polymeric films, superabsorbent gelling materials; compostable materials, such as PLA, combinations thereof, etc. Suitable cleaning sheets may be made according to the teachings of commonly assigned U.S. Pat. Nos. 6,797,357; 6,936,330; D489,537; D499,887; U.S. Pat. Nos. 5,960,508; 6,003,191; 6,048,123; 6,101,661 and/or 6,601,261.

The cleaning sheet may be disposable, i.e. discarded after being soiled. A disposable cleaning sheet may be discarded after a single use. Alternatively, the cleaning sheet may be laundered and restored, for subsequent reuse. For example, a microfiber cleaning sheet may be used more than once. After subsequent reuse, a durable cleaning sheet may then be discarded.

Exemplary locking members include deformable grippers, etc. Deformable grippers may be used to attach the cleaning sheet, because such an attachment works with a variety of sheet materials, does not require extra manufacturing steps in the sheet (such as the addition of adhesive) and may last for the life of the cleaning apparatus. While uniform and substantially identical attachments may be used, locking members may comprise two or more different attachment types. Three or more attachments may be used. If four attachments are utilized, they may be disposed in a rectangular pattern comprising two front attachments and two rearward attachments. One or more of the attachments may be disposed on the top surface of the head and generally face away from the bottom surface of the head and target surface during cleaning. This disposition of attachments provides the benefit of convenient access thereto.

Alternatively or additionally, the locking members may comprise a hook and loop system as is known in the art. The bottom of the head may be totally or partially covered with hooks. The cleaning sheet may comprise loops. By engaging the hooks into the loops, the cleaning sheet may be releasably attached to the head. If desired, the implement may further comprise an adapter plate to allow different sizes and types of cleaning sheets to be utilized, as illustrated by commonly assigned U.S. Pat. No. 6,842,936.

Regarding the one or more nozzles/outlets, any suitable nozzle/outlet may be utilized. Some examples of suitable nozzles are disclosed in U.S. Pat. Nos. 5,888,006; 5,988,920; 6,206,058; 6,217,889; 6,386,392; 6,663,306; 6,722,806 and 7,172,099. When using a single nozzle, the fluid spray pattern may diverge as fluid is expelled from the nozzle. The pattern sprayed from a single nozzle may be a fan or cone shape. Additionally, a plurality of nozzles may be utilized, some suitable examples are disclosed in U.S. Pat. Nos. 3,219,276; 6,540,424; 6,595,712; 6,976,802; 7,264,413 and commonly assigned U.S. Pat. No. 8,186,898.

It can be helpful to illuminate the floor or other target surface being cleaned. For example, the spray pattern may be illuminated and/or the floor (target surface) may be illuminated post-spray. It is believed that if simply the target surface is illuminated post spray, an improper amount of spray may be applied to the target surface which can lead to poor cleaning.

In one example, lights can illuminate the spray during application to the target surface. For example, LED lights may be utilized. Optionally the lights illuminate the target surface. In one particular example, the lights can illuminate the target surface and spray.

The at least one nozzle/outlet may dispense fluid in a spray, mist, stream, fan or other desired pattern, collectively referred to herein as a spray. Each nozzle/outlet may be oriented at a particular azimuthal angle relative to the longitudinal plane and/or the horizontal plane. The orientation of a nozzle is determined by the orientation of the centerline of that nozzle. It is worth noting that a mist may provide for even distribution, without saturation of the target surface. At least one nozzle may be disposed on each side of the longitudinal centerline, and spaced equally or unequally therefrom Fluids sprayed from cleaning apparatuses of the present disclosure may be any fluid usable to treat a target surface. Typical fluids include cleaning fluids, disinfectants, perfumes, etc. A suitable cleaning fluid may be made according to commonly assigned U.S. Pat. Nos. 6,380,151; 8,568,702; 8,808,678; and 10,119,102.

It is worth noting that the overall length of the cleaning apparatus or the length of the support member may require special accommodation when provided for sale at a store. For example, many store shelves lack the vertical clearance required to accommodate the overall length of the cleaning apparatus. And placement of the cleaning apparatus horizontally on shelf may take up too much real estate in the way of shelf length. So, it is contemplated that the first portion of the support member and the second portion of the support member may be disassembled in the package and require assembly prior to use. In such forms, wiring may extend from the first portion to the second portion to provide electrical communication between the actuator and the motor for the pump. Or in such forms, the first portion may comprise male or female connections which mate with complimentary female or male portions, respectively, on the second portion. Additionally detents may be provided to reduce the likelihood that the first portion and the second portion become disconnected during use.

Regarding the packaging of the cleaning apparatuses of the present disclosure, the first portion of the support member and the second portion may be disposed in a generally parallel manner And, where wiring extends from the first portion to the second portion, respective ends of the first portion and the second portion which are meant to be engaged during use may be positioned in the package proximally to one another. Where the first portion/second portion comprise complimentary male/female connectors, the first portion and the second portion may be positioned within the package in any suitable manner.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning apparatus comprising:

a support member comprising:

a first portion having a length, a first end and an opposing second end and a handle disposed at the first end of the first portion;

a second portion having a first transition disposed at the second end of the first portion and a second transition spaced apart from the first transition;

a first support and a second support joining the first transition and the second transition, wherein the first support and the second support are both offset from the first portion;

a liquid management system disposed, at least in part, between the first transition and second transition, the liquid management system comprising a reservoir receiver which receives at least one liquid reservoir or comprises at least one liquid reservoir formed integrally therewith, wherein the liquid management system has a void positioned between the first transition and the second transition and extending continuously from the first support to the second support and extending completely through the liquid management system, wherein the void is more extensive than the at least one liquid reservoir;

a cleaning head moveably attached to the second transition by a cleaning head connection between the second transition and the cleaning head, wherein the cleaning head has a lower surface oriented away from the cleaning head connection;

wherein when the support member exhibits a longitudinal angle of six degrees or less with respect to a horizontal plane defined by the lower surface when the lower surface is positioned to face a surface to be cleaned the cleaning apparatus exhibits a vertical height of less than 110 mm, and wherein the at least one liquid reservoir has a volume of more than about 475 ml.

2. The cleaning apparatus according to claim 1, wherein the reservoir receiver receives the at least one liquid reservoir.

3. The cleaning apparatus according to claim 2, wherein the at least one liquid reservoir is removably connectable to the reservoir receiver.

4. The cleaning apparatus according to claim 3, wherein the at least one liquid reservoir is re-fillable.

5. The cleaning apparatus according to claim 1, wherein the reservoir receiver is in liquid communication with a pump and one or more nozzles and/or outlets disposed on the cleaning head.

6. The cleaning apparatus according to claim 5, wherein the pump is operatively connected to a motor which is in electrical communication with a power source.

7. The cleaning apparatus according to claim 6, wherein the power source is a battery pack comprising one or more batteries.

8. The cleaning apparatus according to claim 7, wherein the one or more batteries are re-chargeable.

9. The cleaning apparatus according to claim 6, wherein the first portion comprises an actuator which is in electrical communication with the power source and the motor.

10. The cleaning apparatus according to claim 6, wherein the pump is manually operated.

11. The cleaning apparatus according to claim 1 wherein the support member has a length, wherein the first portion has the first portion length, wherein the second portion has a second portion length, wherein the first portion length is at least 30 percent of the length of the support member.

12. The cleaning apparatus according to claim 11, wherein the first portion length is between 30 percent and 70 percent of the length of the support member.

13. The cleaning apparatus according to claim 1, wherein the at least one liquid reservoir has a centroid of interior space disposed in a vertical plane that is disposed within 40 mm or less from a bisecting plane.

14. The cleaning apparatus according to claim 13, wherein the centroid of interior space is disposed in the vertical plane that is disposed between about 0 mm to about 40 from the bisecting plane.

15. The cleaning apparatus according to claim 1, wherein the support member exhibits a transverse angle that is about 30 degrees or less from the horizontal plane.

16. The cleaning apparatus according to claim 15, wherein the transverse angle with respect to the horizontal plane is from between about 5 degrees to about 30 degrees.

17. The cleaning apparatus according to claim 1, wherein the at least one liquid reservoir is integrally formed with the reservoir receiver.

18. A cleaning apparatus comprising:

a support member comprising:

a first portion having a length, a first end and an opposing second end and a handle disposed at the first end of the first portion;

a second portion having a first transition disposed at the second end of the first portion and a second transition spaced apart from the first transition;

a first support and a second support joining the first transition and the second transition, wherein the first support and the second support are both offset from the first portion;

a liquid management system disposed, at least in part, between the first transition and second transition, the liquid management system comprising a reservoir receiver which receives at least one liquid reservoir, wherein said liquid management system has a void positioned between the first transition and the second transition and extending continuously from the first support to the second support and extending completely through the liquid management system, wherein the void is more extensive than the at least one liquid reservoir;

a cleaning head moveably attached to the second transition by a cleaning head connection between the second transition and the cleaning head, wherein the cleaning head has a lower surface oriented away from the cleaning head connection; and a release member positioned between the first transition and the cleaning head;

wherein when the support member exhibits a longitudinal angle of six degrees or less with respect to a horizontal plane defined by the lower surface when the lower surface is positioned to face a surface to be cleaned the cleaning apparatus exhibits a vertical height of less than 110 mm, and wherein the at least one liquid reservoir has a volume of more than about 475 ml.

* * * * *